US005188045A

United States Patent [19]

Fyler et al.

[11] Patent Number: 5,188,045

[45] Date of Patent: Feb. 23, 1993

[54] SYSTEM FOR JOINING LIMP MATERIAL SEGMENTS WITH EASING

[75] Inventors: Donald C. Fyler, Wellesley, Mass.; Layton G. Hale, Livermore, Calif.

[73] Assignee: The Charles Stark Draper Laboratory, Inc., Cambridge, Mass.

[21] Appl. No.: 711,712

[22] Filed: Jun. 12, 1991

[51] Int. Cl.[5] ..... D05B 19/00; D05B 27/06

[52] U.S. Cl. ..... 112/121.26; 112/306; 112/320

[58] Field of Search ..... 112/121.26, 306, 314, 112/320, 121.11, 312, 313, 315; 226/111

[56] References Cited

U.S. PATENT DOCUMENTS

| | | | |
|---|---|---|---|
| 4,037,546 | 7/1977 | Kleinschmidt | 112/121.26 |
| 4,201,145 | 5/1980 | Blessing | 112/306 |
| 4,757,773 | 7/1988 | Nomura et al. | 112/306 |
| 5,097,777 | 3/1992 | Porter | 112/306 |

*Primary Examiner*—Peter Nerbun
*Attorney, Agent, or Firm*—Lahive & Cockfield

[57] ABSTRACT

The invention includes in one form a sewing machine, two trackers (mice) to track the ends of material-to-be-joined, and a controller for controlling stitch formation to achieve precise control of the material position, permitting desired easing (positive or negative). A long table is preferably used with a separation plate so that the two panels-to-be-joined can be laid out flat and separated during sewing. The mice slide in tracks so they will move in a straight line. The mice are adapted so that tension can be maintained and that the mice can be pulled back when the seam is done. Optical encoders are used so that the position of the mice, and thus end-points of the panels, can accurately be determined. The sewing machine has an attachment that provides differential feed of the two plies in response to the desired and actual position of the stitches.

6 Claims, 6 Drawing Sheets

SYSTEM FOR JOINING LIMP MATERIAL SEGMENTS WITH EASING

BACKGROUND OF THE INVENTION

The present invention is in the field of assembly systems for articles made of limp material, and more particularly related to sewing machines.

Sewing machines are well known in the prior art to join portions of a multiple layer limp fabric (or material) workpiece along a curvilinear path, thereby forming a seam. Generally, such machines include a needle adapted for reciprocating motion along a needle axis which is angularly offset from a planar workpiece support surface. In most prior art sewing machines, manually or automatically controlled, feed devices present the fabric-to-be-joined to the needle along a feed axis which is fixedly positioned with respect to the needle axis and the workpiece support surface. By way of example, such devices include feed dogs, rolling cylinder feeds and tractor feeds (using endless belts over rollers).

Robots have long been applied successfully throughout industry in a variety of applications as diverse as welding, painting and assembly. By far the most challenging of these applications has been assembly. A significant amount of Progress has been made in improving the ability of robots to accomplish complex assembly tasks but for the most part research has concentrated on assembly of rigid parts made of hard plastic and metals, materials typically found in assembly of small mechanical or electrical devices. Much less research has been directed towards the assembly of flexible parts such as textiles. Development of flexible material handling technology is necessary in order to introduce robotics into industries based on flexible, or limp, materials, such as apparel manufacturing.

Since textiles are flexible materials, they pose problems for robotic manipulation which were not encountered in rigid parts manipulation. The inherent limpness of textiles necessitates design of specialized handling equipment to assure that the flexible workpiece does not distort during handling. This equipment must be designed to be robust to material properties which affect handling that vary not only from part to part, but also within a single part.

In recent years, there have been significant advances in the automated control of limp material segments, particularly suited for apparel manufacture. By way of example, U.S. Pat. Nos. 4,632,046, 4,607,584, 4,719,864, 4,651,659 and 4,638,749, all assigned to the assignee of the present invention, disclose systems and methods for manipulating and controlling limp material segments generally for presentation to seam joining assemblies, e.g. sewing machines. All of these patents are concerned with the fact that the limp materials are easily deformed. Since the edges of cloth panels which must eventually be aligned are easily deformed, multiple support points are required. Typically, the support points must be placed close enough to the desired edge so that distortions such as curling or folding do not occur during transport. The placement is further complicated by the fact that the cloth's tendency to curl, fold, or wrinkle is highly dependent on material properties such as bending rigidity. Bending rigidity will vary from part to part as material changes (e.g. polyester or wool) and can even vary within a single part, depending on orientation of the gripper to the weave or proximity of the gripper to reinforcements. During manipulation of flexible materials, such as textiles, little force is transmitted back t the positioning device, since the workpiece is easily distorted. As a result, non-contact sensing methods such as vision are often utilized for final alignment before establishing a seam.

U.S. Pat. No. 4,719,864 discloses a feed assembly for a sewing machine which provides near needle control of the segments-to-be-joined.

In connection with automated sewing systems, it has proved to be very difficult to get the ends of a long seam to match up when two plies are sewn together. Slight errors in differential feeding of the two plies to the needle accumulate to large errors by the end of a long seam. Other sources of errors result from uneven drag on the cloth and from mis-cut lengths of material. When the seam is sewn by hand, measures can be taken to correct any noticed misalignment. However, automatically sewn seams using prior art systems generally have large errors if no correction method is used.

Moreover, in many sewing applications, cloth panels cannot always be held firmly in place during the sewing operation since for proper alignment to occur the two cloth parts must be allowed to move in the direction parallel to the seam direction. This motion is accomplished by "ply shifting", i.e. moving one ply relative to another, during the seaming operation. In the simplest case, when two seams are joined, no ply shifting is introduced resulting in a flat seam after sewing. If one ply is shifted relative to another during sewing, then bunching occurs, This effect, known as easing, may be selectively utilized to shape garments during seaming.

In the prior art, several methods have previously been used to control end alignment and easing. The most common method is to use a human operator, together with workpieces having reference notches cut into the edges of the segments-to-be-joined, where the notches are positioned to overlap when the seam is properly established with desired easing. As the operator hand sews, he attempts to align the notches. This operation requires great skill but is tedious and characterized by relatively low productivity. Further, good operators are hard to find.

Alternatively, automatic machines without end feedback are used, where end alignment control is manually adjusted during sewing so that the ends visually line up after seaming. However, slight variations in material properties can cause end aligning errors. This problem becomes amplified with longer seams.

More recently, sewing systems have used a single "mouse" whereby both ply end corners (at the end of the desired seam-to-be-made) are clamped together prealigned. The workpiece bearing the opposite end of the seam is then drawn toward the needle while the mouse is dragged along to maintain tension and to assure the trailing ends line up. The main problem with this method is that the easing profile throughout the seam is not well controlled. Normally, if plies are miscut, it is considered best to put constant, minimal, easing all along the seam to correct for the length error. However, with the single mouse system (due to properties of feed dog mechanisms), a high amount of easing is generally established at the beginning of the seam, and the easing typically drops to zero easing by the end of the seam. In attempting to overcome this deficiency, some single mouse machines have a differential feed mechanism where an easing profile can be programmed for the entire length of the seam. The problem with this approach is that such easing is accomplished in an open loop manner and any easing caused by the mouse is uncontrolled.

Accordingly, it is an object of the present invention to provide an improved system for establishing a seam joining two (or more) limp material segments.

Another object is to provide an improved seam joining system permitting establishment of seams with continuous control of the regions of the materials being joined.

It is another object to provide an improved seam joining system in which distal ends of the materials-to-be-joined are controlled during the joining operation.

Yet another object is to provide an improved seam joining system permitting predetermined easing to be incorporated on a continuous basis during a seam joining operation.

Still another object is to provide an improved seam joining system permitting predetermined easing to be incorporated in both workpieces-to-be-joined.

SUMMARY OF THE INVENTION

The invention includes a sewing machine, two trackers (mice) to track the ends of material-to-be-joined, and a controller for controlling stitch formation to achieve precise control of the material position, permitting desired easing (positive or negative). A long table is used with a separation plate so that the two panels-to-be-joined can be laid out flat and separated during sewing. The mice slide in tracks so they will move in a straight line. The mice are attached by geared cables to motors so that tension can be maintained if desired and so that the mice can be pulled back when the seam is done. Optical encoders are geared to the cables so that the position of the mice, and thus endpoints of the panels, can accurately be determined.

The sewing machine has an attachment that provides differential feed of the two plies. The differential feed rate is adjusted under control of the controller by a servo motor attached to the differential feed control lever on the sewing machine.

The two optical encoders and a stitch count sensor are monitored by the controller as sewing progresses. From the sensor information, the controller controls seam alignment in the sewing direction through control of the mouse motor torque and/or the differential feed control motor.

Briefly, the sequence of events to control seam end alignment is as follows:

a) Operator places leading edge corners of the overlapped panels accurately under presser foot and trailing edge corners are accurately affixed to a respective mouse clamp. This operation may be accomplished either manually or automatically.

b) After loading, automatic sewing may be started. Initially, mouse cable tension is brought up to a desired value, such as one pound, for a few seconds and then relaxed. This operation pulls out any wrinkles and allows the controller to record stretched length and relaxed length of the material. The controller also calculates spring rate from this data.

c) The controller then determines a sewing profile that will nominally make the ends line up and also satisfy any easing requirements given by the operator.

d) The sewing machine then starts sewing. At each stitch, the controller determines from the mouse positions whether the seam profile is being sewn correctly and, if not, takes corrective measures by changing the differential feed or changing the drag tension.

e) When the end of the seam is reached, the material is removed from the clamps.

The primary advantage of the invention is that the trailing ends of a seam are monitored throughout the entire seaming operation. This allows alignment of the trailing ends with a minimum of differential feeding. There are several alternate methods of sensing the end positions:

Sensors in table—Rather than using mice to sense end positions, several light sensors may be mounted in the table top to detect when material passed by. This provides periodic updates of the end positions. By way of example, light sensors spacing of about six inches gives satisfactory results in most applications.

Belts—If both plies can be deformed into a straight line along the seam, then they can be held in place by long belts prior to sewing. As the sewing machine sews, the belts can incrementally deliver the material. The two advantages of this method is that the end positions can be known without material springrate affecting accuracy and that loading and unloading of the material is greatly simplified. With this configuration, the belts must be synchronized with the feed dogs so that no stretching or buckling occurs.

Driven Mice—Slight changes in the drag from the mouse can severely disrupt end position sensing if the material stretches. To accommodate this sensitivity, the mice may be driven in a servo loop so that they track the material in the feed direction and restrain in the side-to-side direction.

Encoder Feed Sensing—Although a mouse can sense end position without accumulating errors, it can show errors from stitch to stitch. An encoder wheel near the feed dogs may be used to sense incremental motion precisely, providing rapid correction to feed errors while the mouse is used only for sensing actual end position.

Drag Control Near Needle—Where drag is used to control feed, that drag may be established near the feed dogs with a roller or drag foot. Causing drag separately near the feed dogs eliminates coupling caused by material deflection.

Edge Aligners—A separate device may be used to control edge alignment.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
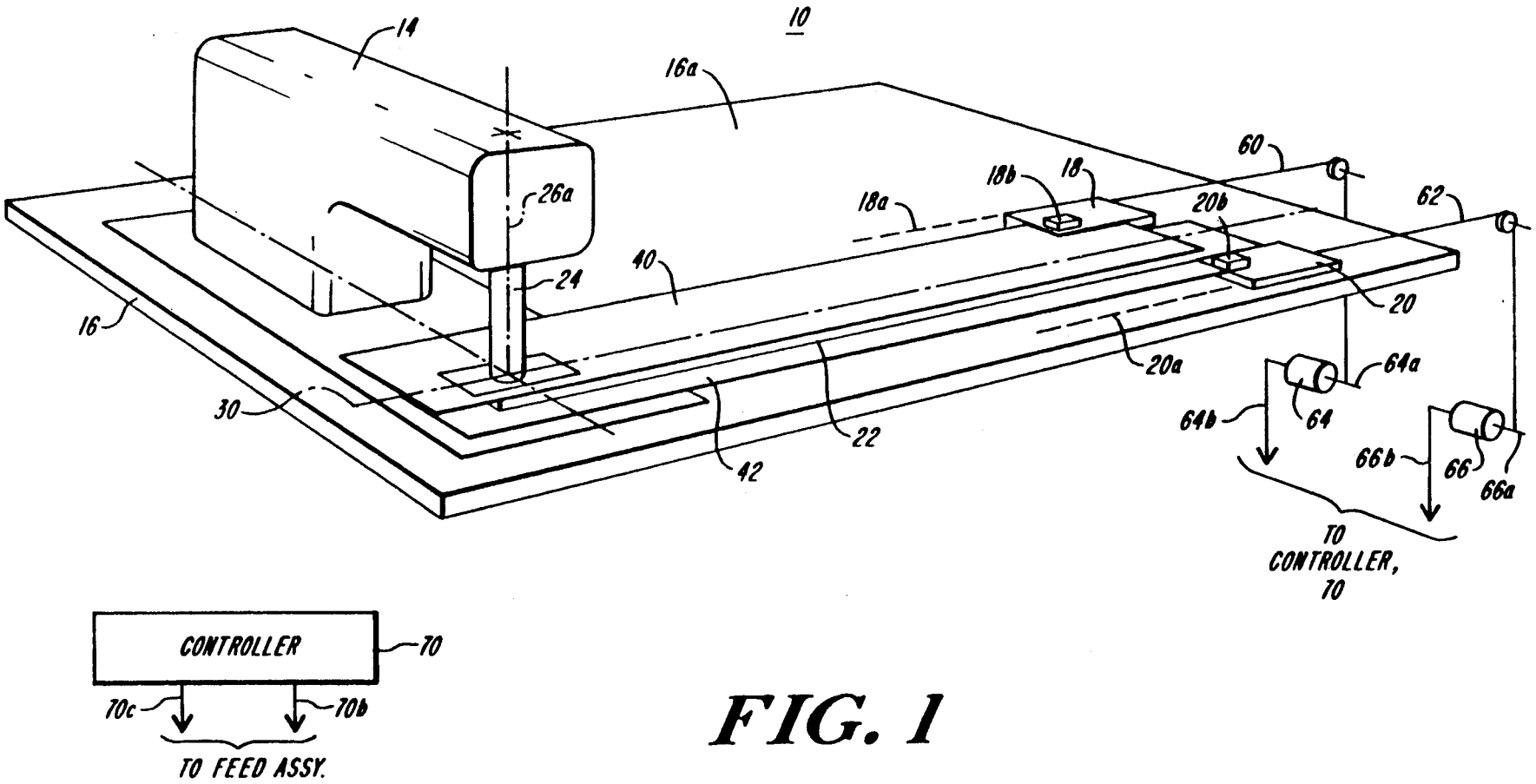
FIG. 1 shows in perspective view a seam joining system in accordance with the present invention.

An exemplary seam joining system 10 embodying the invention is shown in FIG. 1. System 10 includes a sewing machine 14, a workpiece support table 16, an upper ply tracker (mouse) 18 and a lower ply tracker (mouse) 20, and a ply separator 22. The top surface 16*a* of table 16 is generally planar and horizontal. The sewing machine 14 includes a conventional needle assembly (indicated generally by reference designation 24) including an elongated straight needle 26 (extending along a needle axis 26*a* perpendicular to surface 16*a*), an associated driver adapted to drive needle 26 in a reciprocal motion along axis 26*a* and a presser foot 28 (not shown in FIG. 1). Thus, the locus of needle 26 is an elongated region extending along axis 26*a* perpendicular to and intersecting surface 16*a*. In alternate embodiments, the needle may be curved and extend along a curved needle axis. The sewing machine 14 further includes a conventional looper or bobbin assembly (beneath the table 16) adapted to interact with the thread in needle 26 to form stitches in limp material on surface 16*a* passing the needle locus in the direction of a feed axis 30 from an upstream end to a downstream end (i.e. right-to-left as shown in FIG. 1).

Figure 2:
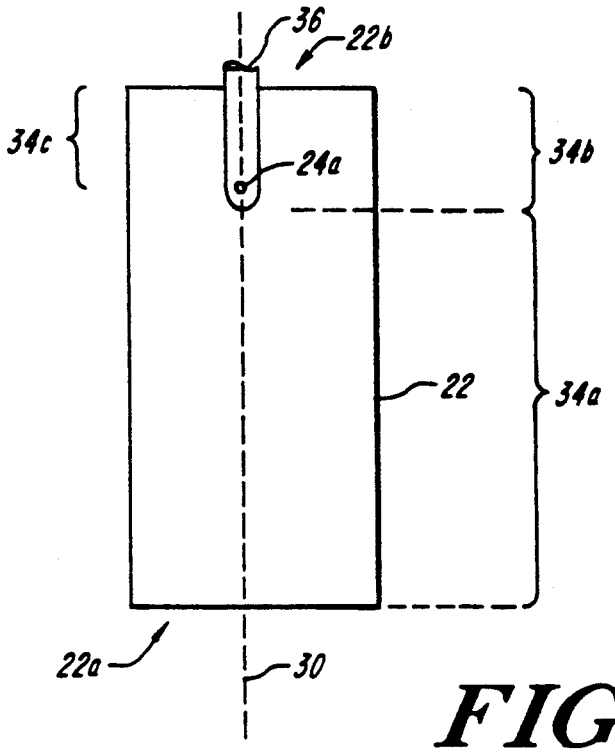
FIG. 2 shows the ply separator for the system of FIG. 1.

The ply separator 22 in FIG. 1 is a planar plate having smooth upper and lower principal surfaces disposed above and substantially parallel to the top surface 16*a* of table 16. The exemplary separator 22 of system 10 is shown in FIG. 2 with reference to the needle axis 26*a* and feed axis 30. That separator 22 includes portions 34*a*, 34*b* and 34*c*. Portion 34*a* is generally rectangular and extends on both sides of axis 30 from the upstream end 22*a* of plate 22 to a point along axis 30 just upstream of needle axis 26*a*.

Portions 34*b* and 34*c* are also generally rectangular, but each extends only on one side of axis 30 from the downstream end of portion 34*a*, i.e. so that there is a longitudinally extending gap 36 between portions 34*b* and 34*c* from a point upstream of the needle locus to the downstream end 22*b* of separator 22. As shown in FIG. 1, the plate 22 is positioned between upper and lower limp material segments 40 and 42, respectively, which are to be joined by system 10. The smooth surfaces of separator 20 permit relatively low friction motion of segments 40 and 42 on surface 16*a*.

Figure 3:
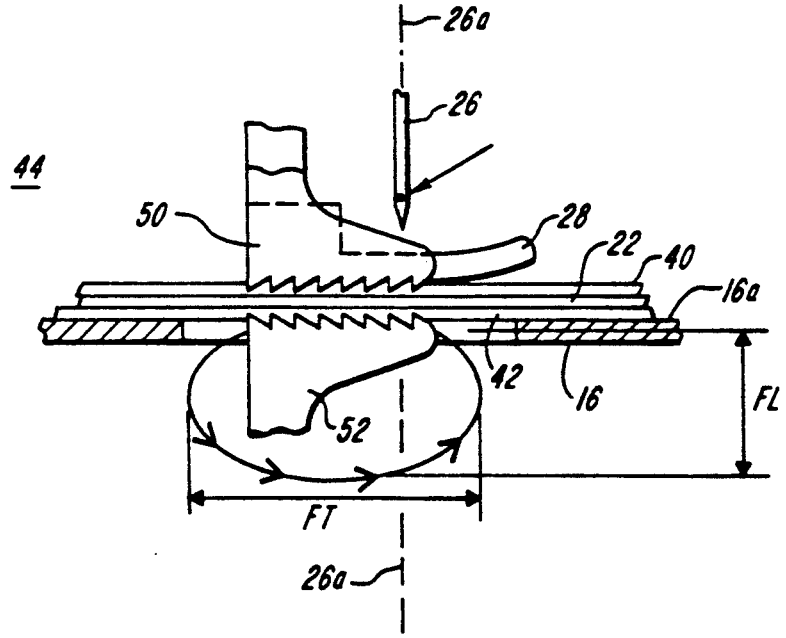
FIG. 3 shows a side sectional view of the differential feed system of the system of FIG. 1.

The sewing machine 14 also includes a differential feed assembly 44 (not shown in FIG. 1) disposed adjacent to the needle assembly 24. Assembly 44 is adapted to selectively and independently advance the segments 40 and 42 in the direction of feed axis 30 past the needle locus (i.e. axis 26*a*). In the presently described embodiment, feed assembly 44 includes an upper feed dog 50 disposed opposite the upper surfaces of portions 34*b* and 34*c* of separator 22 and a lower feed dog 52 disposed opposite the lower surfaces of portions 34*b* and 34*c* of separator 22. Conventional drivers are provided for the feed dogs 50 and 52. Assembly 44 is shown in simplified form in FIG. 3.

Generally, the feed dog drivers establish feed dog motion in an elliptical-like path that is timed to the vertical motion of the needle 26. The feed dog motion is characterized by its feed travel (FT) and feed lift (FL), illustrated in FIG. 3 for feed dog 52. Feed travel is adjustable to set the stitch length. Feed lift allows the machine 10 to accommodate a wide variety of material weights and thicknesses. Feed dogs drive the adjacent face of cloth (40 or 42) with a high friction surface bearing teeth that are spaced and sized based on material weight or thickness. The spring loaded presser foot 28 biases the material to be sewn against the respective surfaces 34*b* and 34*c* of separator 22. The presser foot 28 has a relatively low friction, polished surface so that it does not retard the motion of the upper ply. With this feed assembly a prior art system using only a lower feed dog, easing can be imparted to a seam by methods known either as "tension control" or "drag control". By applying tension to one ply, its motion past the needle 26 is effectively retarded relative to the other ply, resulting in differential feed of the seam. However, with the present invention, in the form of system 10, easing can also be imparted to a seam through mechanical means by overfeeding a cloth ply. This can be accomplished with the "variable top feed" system that consists of the independently controlled top feed dog 50 in combination with the "conventional" lower feed dog 52. This configuration provides direct control of easing since each cloth ply 40 and 42 is in direct contact with a feed mechanism. The motion of the respective feed dogs is responsive to first and second feed signals applied (via lines 70*a* and 70*b*) to the respective feed drivers.

The trackers (or mice) 18 and 20 are positioned on slides (indicated in part by broken lines 18*a* and 20*a* in FIG. 1) in table 16, permitting linear motion along axes parallel to feed axis 30. Each of trackers 18 and 20 includes a clamp assembly (indicated schematically by reference designations 18*b* and 20*b* in FIG. 1) which may be selectively operated to clamp a portion of segments 40 and 42 adjacent to the desired seam end points to the respective ones of trackers 18 and 20. In the illustrated embodiment, each of trackers 18 and 20 is coupled by a cable (cables 60 and 62, respectively) to the input shaft (64*a*, 66*a*) of a torque motor (motors 64 and 66, respectively). The shaft position encoders for motors 64 and 66 are coupled via lines 64*b* and 66*b* to a controller 70.

In operation, the limp material segments 40 and 42 to be joined are placed in overlapping relation on surface 16*a*, i.e. in a plane parallel to the surface 16*a*. The segments are positioned so that the start points of each of the seams-to-be-formed are overlapping at a known reference point along axis 30. The motors 64 and 66 are operated to wind the cables 60 and 62 about the respective motor drive shafts so that the trackers 18 and 20 are withdrawn from the needle axis until those trackers are adjacent to the desired seam end points on the respective segments 40 and 42.

Then, the clamp assemblies of the trackers 18 and 20 are then affixed to portions of the segments 40 and 42 so that the precise location (along axis 30) of the end points of each of the seams to be formed are indicated on lines 64*b* and 66*b*. At this point, in response to feed signals generated by controller 70, the operation of differential feed assembly 44 is initiated so that the segments 40 and 42 are presented in a controlled manner to needle assembly 24, independently controlling the feed of segments 40 and 42. As this feed occurs, the trackers 18 and 20 are drawn along by the segments, and their respective encoders report (via lines **64*b* and 66*b*) the correct position of the trackers to controller 70. In response, controller 70 generates the feed signals so that the desired seam is established with the desired easing in each of the segments. All of these operations are performed under the control of controller 70** in the present embodiment.

An automated easing system which must operate in a factory environment must be responsive to changes in cloth material properties. Within a typical production run in the tailored clothing industry, material type varies from natural fabrics to synthetics, as well as to natural/synthetic blends. Material properties, such as shear stiffness, compressibility, bending stiffness, ply thickness, coefficient of friction may be different for each of these material types. As these properties change, the easing characteristics of the material are also effected. In addition, machine properties, such as presser foot pressure, feed dog height/stroke and general machine wear also affect the quality of an eased seam. In a manual/operation the prior art, a trained operator can often intuitively adjust for varying material properties and minor machine mis-adjustments by modifying the amount of tension on the eased ply appropriately. An automated system, however, must either be designed in such a way as to not be sensitive to material properties and machine wear/set-up or be programmable to adjust for variations in these parameters.

A prior art technique which improves the quality of eased seams is measurement of material properties before sewing followed by appropriate adjustment of the sewing system to compensate for material characteristics. Systems for measuring material properties such as FAST and Kawabata currently exist and have been successfully used in this matter to improve sewn seam quality. Kawabata, Dr. Sueo, "Japanese Experience: Using Fabric Mechanical Properties To Predict Tailorability And Improved Garment Appearance", Proceedings of Advanced Apparel Technologies: Blueprint for the Future pp. 73–92, Oct. 25, 1988. Unfortunately, as a sewing machine wears or falls out of adjustment the appropriate machine settings for a particular material will change. It is therefor important to not only measure material properties, but to measure the properties of the machine/material interface. The present invention utilizes feed forward control based on control parameters.

Generally, assembly of two or more cloth parts by sewing is a process that requires many specifications to assure a good quality garment. A primary such specification is the differential shift between two layers of fabric along the sewing axis. This differential shift is known as "easing" or fullness. Easing may be specified as y inches of shift over x inches of seam length. Easing may equivalently be defined as the relative strain that exists between layers of cloth in a flat seam. This is a non-dimensional number having a magnitude of a few percent. The specification may be considered as a set of curves, $y=f(x)$ and its derivative $y'=dy/dx$, named respectively, offset and easing.

Using this definition of easing, the sewing machine 10 can be modeled as an integrator. As sewing proceeds, easing integrates along the seam to cause relative shift between layers, referred to as offset. The mathematical relationship between offset and easing at a point x along the seam is represented by:

$$\text{offset} = y(x) = \int_0^x y'(u)du \tag{1}$$

$$\text{easing} = y'(x) = \frac{dy}{dx} \tag{2}$$

Thus, the sewing machine 10 can be modeled as an integrator with respect to x, which is equivalent to integration with respect to time if its speed (v) is constant. These equivalent models are:

$$y'(x) \longrightarrow \boxed{\int dx} \longrightarrow y(x) \tag{3}$$

$$y'(x) \longrightarrow \boxed{\frac{v}{s}} \longrightarrow y(x) \tag{4}$$

$$v = \frac{dx}{dt} \quad \frac{1}{s} \longrightarrow \int dt \tag{5}$$

A mathematical systems model of easing control using an actuated feed adjustment mechanism may be established. The actuated feed adjustment mechanism can control the individual rates with which the top and bottom plies are fed through the sewing region. The model consists of three parts: 1) the actuator, 2) the feed adjustment mechanism, and 3) the sewing machine. The block diagram of the system model, shown in FIG. 4, contains a drag disturbance d, and a feed uncertainty $\gamma$.

Figure 5:
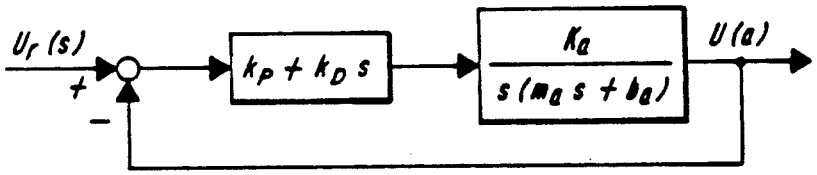
FIG. 5 shows a model for the servo motor of the model of FIG. 4.
Figure 6:
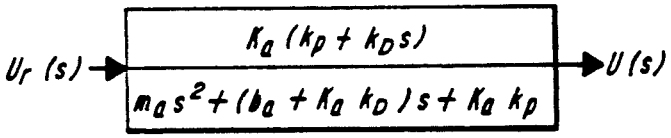
FIG. 6 shows in block diagram form the system of FIG. 1.

The sewing machine is modeled as an integrator with respect to seam position x. The feed mechanism is modeled with a nonlinear function g(u) that describes the kinematics of the differential feed adjustment mechanism. The function g(u), whether empirical or analytical. The derivative of g(u) is positive. In this model, the actuator, $G_a$, is a D.C. electric servo motor with position feedback and PD compensation. The model of the second order system is shown in FIG. 5. The transfer function for the servo motor is shown in FIG. 6.

The compensator parameters $k_p$ and $k_D$ are uniquely determined by the desired natural frequency $\omega_n$ and damping ratio $\xi$:

$$\omega_n^2 = \frac{K_a k_p}{m_a} \quad 2\xi\omega_n = \frac{b_a + K_a k_D}{m_a} \tag{6}$$

Figure 4:
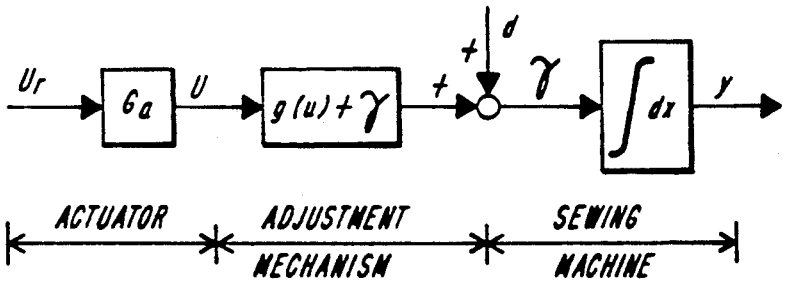
FIG. 4 shows a process model for the differential feed controller of the system of FIG. 1.

Speed or material dependent variation is an uncertainty in the feed adjustment mechanism and is represented by $\gamma$ in FIG. 4. Any drag placed on the fabric as il is being sewn is treated as a disturbance, and is unrelated to the control input. Drag disturbances are shown in d in FIG. 4. End position measurement is effected by drag and, the position measurement is also corrupted with noise from the intermittent feed of the sewing machine.

The process model for differential feed control at FIG. 4 consists of linear dynamic elements and a nonlinear kinematic function. Unknown disturbances and uncertainties, having bounds determined by testing, are included in the model. As described more fully below, the controller developed uses feedback to stabilize the system and to reject disturbances. Feed forward is used to reduce following error.

The feed forward command is derived directly from the process model by requiring the system to exactly follow the reference, given that the actuator is sufficiently fast to track the reference. A linear approximation to the nonlinear feed adjustment function g(u) is used with $\gamma$ and d considered to be unknown.

$$y' \cong g_0 + g_0' u(x) \tag{7}$$

$$u(x) = \frac{y_r'(x) - g_0}{g_0'} \tag{8}$$

Figure 7:
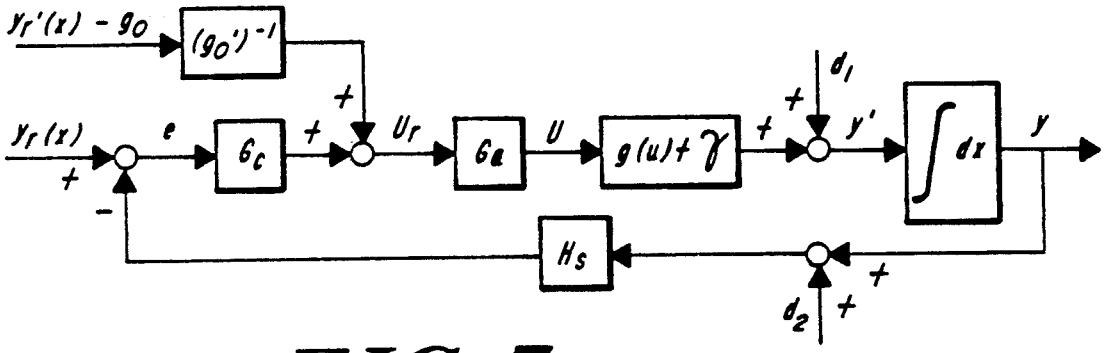
FIG. 7 shows in block diagram form the system of FIG. 1.

A feedback loop is used to stabilize the system since uncertainties integrate to arbitrarily large error. The block diagram of the system is shown in FIG. 7, with transfer functions $G_c$ and $H_s$ for the compensator and sensor, respectively.

The control of offset y is merely a specification of the more critical control variable easing y'. In order to obtain a "quality" seam, easing must be evenly placed, resulting in a specified offset. A "poor" seam may meet offset specifications, but have unevenly distributed easing. The system filters noise contained in the feedback signal to insure seam quality.

The intermittent feed motion of the sewing machine is a source of high frequency noise, typically greater than 60 Hz. The high frequency content of $d_1$ is filtered by the integrator, so, very little effect on feedback is anticipated. The high frequency content of $d_2$ is filtered by the sensor provided it has adequate damping. Otherwise, the sensor generates noise at its resonant frequency.

Devices near the sewing machine such as edge aligners, folders, or sensors may impose constant and/or sudden drag disturbances. The effect of these disturbances on the process may be significant, but the closed-loop system substantially eliminates them over time. The effect on the feedback loop may be insignificant provided that the distorted length of material is short. However, for long seams, disturbance far from the sewing machine may result in a significant length variation.

A simple proportional compensator is used to stabilize the system, with the gain selected to compromise between disturbance rejection and noise amplification. Since an integrator derives steady state following error to zero, therefore a PI compensator is preferably used rather than a P compensator. The P term may be replaced with a low pass filter for particularly noisy feedback signals. This low pass Plus integral controller is referred to as an LI compensator.

Figure 8:
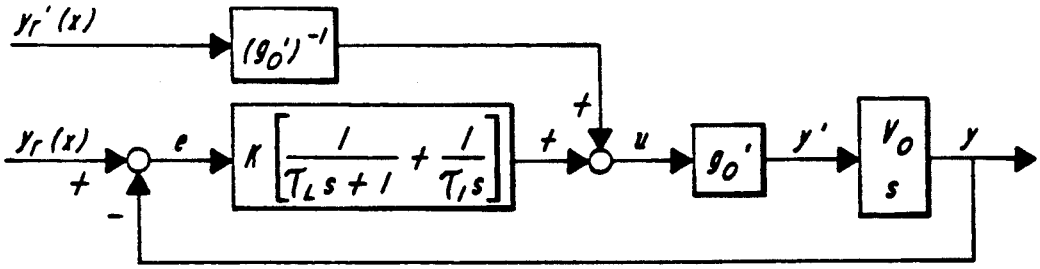
FIG. 8 shows a simplified block diagram of the feed forward LI controller of the system of FIG. 1.

The block diagram of the feed forward, LI controller, is shown in simplified form in FIG. 8. The actuator dynamics are relatively insignificant with a transfer function of unity when the time constant of the low pass filter is a factor of three or more greater than the actuator. Thus, $G_a \rightarrow 1$. The sensor dynamics are similarly insignificant for the same reasons, since noise at its resonate frequency must be filtered.

Figure 9:
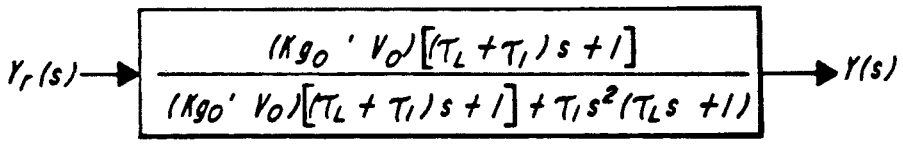
FIG. 9 shows the transfer function of the system of FIG. 8.

As a result, $H_s \rightarrow 1$. The kinematic function (differential feed adjustment mechanism, $g(u) \rightarrow g_0'$) is linearized. With the sewing speed having constant ($V_0$), the sewing machine can be expressed as shown in FIG. 8, with the closed loop transfer function as shown in FIG. 9.

Figure 10:
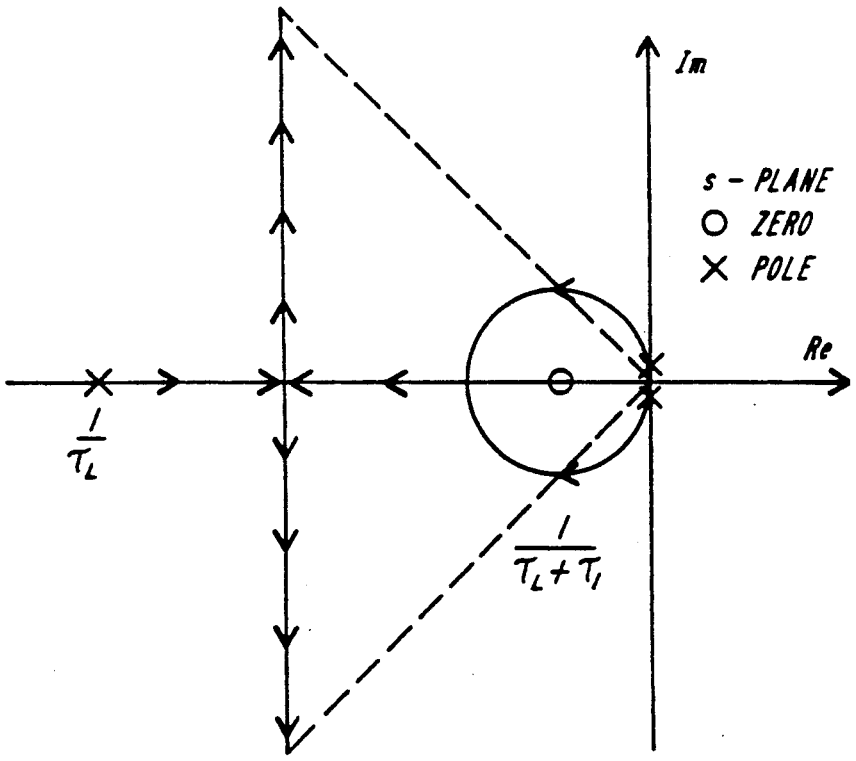
FIG. 10 shows a root locus diagram representative of the transfer function of FIG. 9.

The gain K is determined from the transfer function for a required low pass filter time constant $\tau_L$, and a desired damping ration $\xi$. The root locus method for graphically representing pole movement in the complex plane is useful for visualizing the algebra. The basic rule requires open-loop poles to move towards open-loop zeroes as K changes from zero to infinity. Excess poles move toward radially spaced asymptotes The corresponding root locus diagram is show in FIG. 10.

A reasonable upper limit on gain K is obtained by placing complex poles at the optimal damping ratio $\xi = 0.707$, represented as 45° lines. Critically damped poles, $\xi = 1.0$ set a reasonable lower limit on K. The single pole is interpreted as the decay following error $\tau_e$, while the pole pair indicates the dynamic response system $\tau_s$. Approximate algebraic relationships between system parameters and pole locations are given below. For $\tau_I >> \tau_L$:

$$\frac{\tau_s}{\tau_L} \cong 2\xi \tag{9}$$

$$\frac{\tau_e}{\tau_L} \cong 1 + \frac{\tau_I}{\tau_L} \tag{10}$$

$$(Kg_0'V_0) \cong \frac{1}{\tau_L}\left(\frac{1}{2\xi}\right)^2. \tag{11}$$

Exact relationships between system parameters and pole locations are given as (for $\frac{\tau_I}{\tau_L} \geqq 4\xi(\xi + 1)$):

$$\omega\tau_L = 4\xi\left(1 + \frac{\tau_I}{\tau_L}\right)\left\{\left[(2\xi)^2 + \frac{\tau_I}{\tau_L}\right] + \left[\left((2\xi)^2 + \frac{\tau_I}{\tau_L}\right)^2 - 4(2\xi)^2\left(1 + \frac{\tau_I}{\tau_L}\right)\right]^{\frac{1}{2}}\right\}^{-1} \tag{12}$$

$$\frac{\tau_e}{\tau_L} = \frac{1}{1 - 2\xi\left(\frac{\tau_L}{\tau_s}\right)} \tag{13}$$

$$(Kg_0'V_0) = \frac{1}{\tau_s}\left(\frac{\tau_I/\tau_L}{1 + \tau_I/\tau_L}\right)\left[2\xi + (1 - (2\xi)^2)\frac{\tau_L}{\tau_s}\right]. \tag{14}$$

The above-described feed forward LI controller was implemented on the system 10 of FIG. 1. As mentioned, the LI controller measures the interaction between the sewing machine and the fabric being sewn and adjusts the feed mechanism such that the desired output is obtained.

Figure 11A:
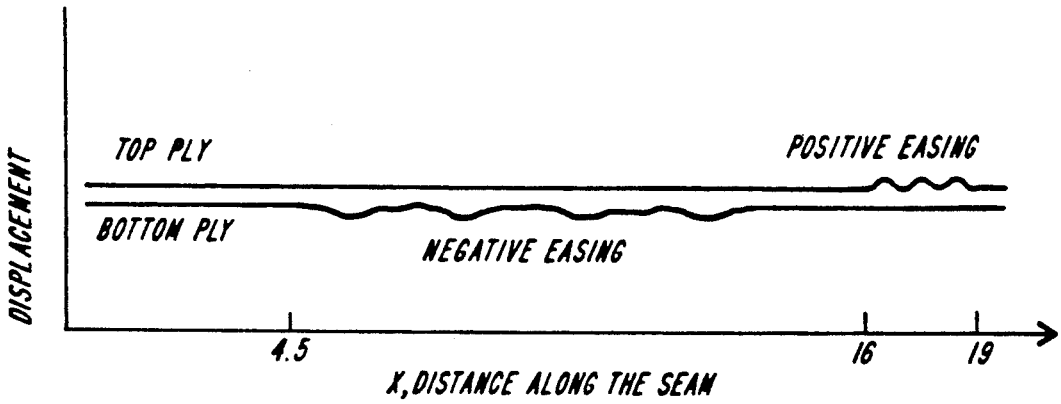
FIG. 11A shows an exemplary easing profile.
Figure 11B:
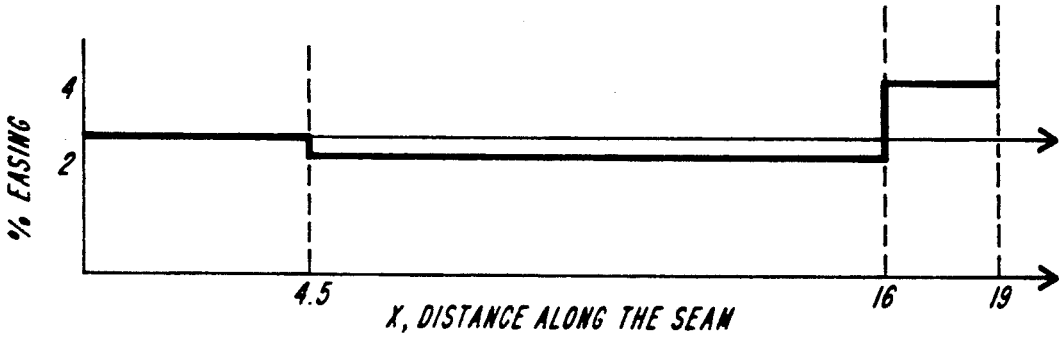
FIG. 11B shows the per cent (%) easing curve for the seam corresponding to the profile of FIG. 11A.
Figure 11C:
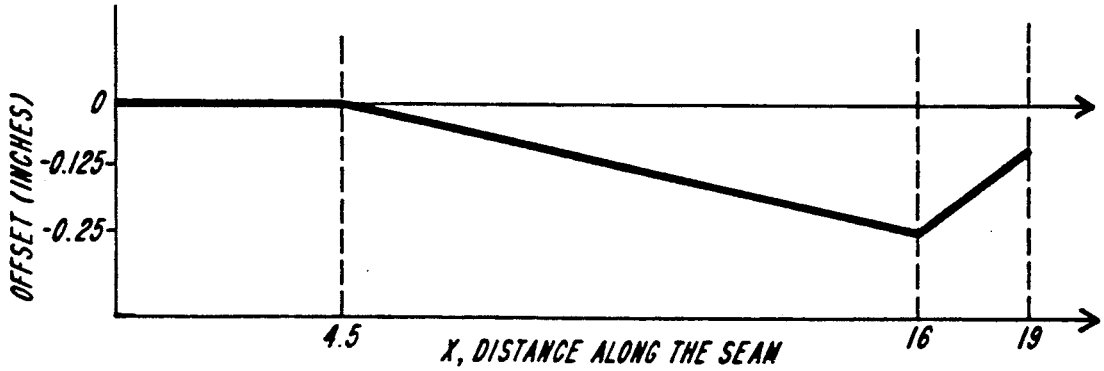
FIG. 11C shows the offset curve for seam corresponding to the profile of FIG. 11A.

In operation, an exemplary easing profile was used in the form shown in FIGS. 11A, 11B and 11C. The profile is entered into the controller 70 by specifying the desired offsets at certain locations along the desired seam. For this exemplary seam, the seam is to be sewn flat (no easing) for the first 4.5 inches, it is to have −0.25 inch offset by the time it has sewn 16 inches and finally, it is to have a −0.125 inch offset when it finishes the seam at 19 inches. This easing profile is similar to that of the inseam of a tailored sleeve.

The next item to be entered to controller 70 is the feed forward gain for the material about to be sewn. Since the ability to ease is different for materials, the feed forward gain is used to fine tune the controller for the specified material being used. The appropriate value for the feed forward gain for a particular material can be experimentally determined by averaging two test runs. Generally, this value related to the material's stiffness.

After entering the easing profile and the feed forward gain, the trailing edge of each ply of cloth is clamped to its tracer or mouse, and the leading edge is placed under the presser foot. The sewing machine's foot pedal is then depressed and the seam is sewn. During sewing, the controller controls the feed mechanism to produce the desired easing output.

Figure 12:
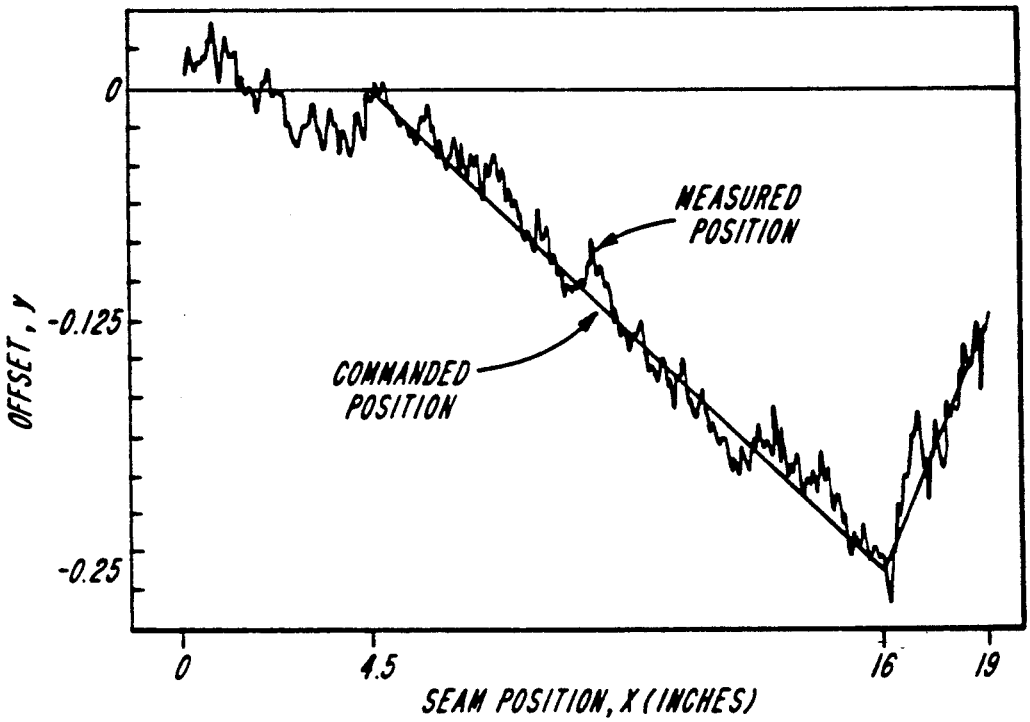
FIG. 12 shows a plot of commanded and measured offset for the seam obtained for the profile of FIG. 11A.

FIG. 12 shows a plot of the desired offset and measured offset while sewing the seam profile set forth in FIGS. 11B and 11C. The material sewn was a worsted wool and the sewing speed was 4000 stitches/min. at 10 stitches/inch (thus, taking about 3 seconds to sew the seam). This plot shows that the feed forward LI controller is able to follow the desired input. The plot also shows that the measured offset signal is very noisy.

There are several sources of noise in the measurement of the trailing edge of the plies. The main contributors are cable deflection and cloth deflection. In the system 10, the encoders that measure the position of the mice 18 and 20 are connected to the mice by rubber coated flexible cables 60 and 62. The intermittent feed of the sewing machine creates vibrational waves in these cables. These waves in the cable give erroneous readings as to the location of the mice. To some extent, these vibrational waves can be filtered out in the controller, but additional filtering (filtering over a large number of samples) slows the response of the system. Generally, reducing the waves in the cable cannot be accomplished by putting the cables in tension since any tension on the cables creates elongation in the cloth (another source of measurement error) and changes the characteristics of the way system 10 eases. In the present embodiment, to reduce tension in the cable and to control the unravelling of the cables, the torque motors are controlled under a simple velocity control.

Since each material feeds slightly differently under feed dogs, the feed forward gain for the controller is adjusted for each type of material run through the system. To make the system more adjustable to different material properties, an adaptive controller may be used.

The invention may be embodied in other specific forms without departing from the spirit or essential characteristic thereof. The present embodiments are therefore to be considered in all respects as illustrative and not restrictive, the scope of the invention being indicated by the appended claims rather than by the foregoing description, and all changes which comes within the meaning and rage of equivalency of the claims are therefore intended to be embraced therein.

What is claimed is:

1. System for forming a seam joining a first limp material segment to a second limp material segment, said seam extending along a first predetermined path from a start point to an end point on said first segment, and extending along a second predetermined path from a start point to an end point on said second segment, comprising:

A. a support surface including means for supporting said first and second limp material segments in an overlapping relation and in a segment locus substantially parallel to a workpiece support plane;

B. a sewing machine including:

i. an elongated needle extending along a needle axis, said needle axis being substantially perpendicular to said workpiece support plane;

ii. means for selectively driving said needle in a reciprocal motion in a needle locus extending along said needle axis and intersecting with said support plane; and iii. a differential feed assembly, said feed assembly including means responsive to a first feed signal and a second feed signal for selectively, independently advancing said first and second limp material segments, respectively, in the direction of a feed axis parallel to said support plane and past the intersection of said needle locus with said support plane;

C. separator means for frictionally decoupling the adjacent surfaces of said overlapping segments upstream of said needle locus;

D. first tracker means for generating a first end point position signal representative of the position along said feed axis of said end point on said first segment;

E. second tracker means for generating a second end point position signal representative of the position along said feed axis of said end point on said second segment; and F. a controller including generator means responsive to said first end point signal and said second end point signal to generate said first feed signal and said second feed signal and for controlling said needle, whereby said seam is established with said first and second paths substantially having a predetermined positional relation.

2. A system according to claim 1 wherein said generator means of said controller includes means periodically operative for determining the current position of said predetermined paths with respect to said needle locus and the current position of said end points and for generating said feed signals in response thereto.

3. A system according to claim 1 wherein said separator means includes a smooth surfaced planar plate disposed between said segments and having a downstream end adjacent to and upstream of said needle locus.

4. A system according to claim 3 wherein said plate further includes first and second smooth surfaced plate portions extending from said downstream end of said plate, each of said portions being co-planar with said plate and extending downstream therefrom on a respective side of said needle locus, and wherein said differential feed assembly includes a first feed device and associated driver disposed opposite the top surface of at least one of said first and second portions, and includes a second feed device and associated driver disposed opposite the bottom surface of at least one of said first and second portions, said associated driver of said first feed device being responsive to said first feed signal to provide said advancing of said first segment, and said associated driver of said second feed device being responsive to said second feed signal to provide said advancing of said second segment.

5. A system according to claim 1 wherein at least one of said first and second tracker means includes a slide assembly coupled to said support surface and having a clamp element slidable thereon in a direction parallel to said feed axis, said clamp element having means for selective attachment to an associated one of said segments at a position related to said end point of said segment, and said tracker means further includes an encoder means for generating said end point position signal for said tracker means.

6. A system according to claim 5 wherein said encoder means includes a torque motor and a flexible cable, said torque motor having an encoder and a drive shaft, said cable being coupled at one end to said clamp element and at the other end being wound about the drive shaft of said motor, whereby said cable is unwound from said shaft as said clamp element slides toward said needle locus and the encoder of said motor provides said position signal, and said cable is wound about said shaft as said clamp element slides away from said needle locus.

* * * * *